United States Patent [19]

Hacker et al.

[11] 4,008,453

[45] Feb. 15, 1977

[54] THERMAL CHANGE-OVER SWITCH

[75] Inventors: Dieter Hacker, Leingarten I; Rolf Jäger, Heilbronn-Horkheim; Dieter Lettau, Heilbronn, all of Germany

[73] Assignee: Grossag Gesellschaft Mit Beschrankter Haftung, Germany; a part interest

[22] Filed: Mar. 25, 1975

[21] Appl. No.: 561,893

[30] Foreign Application Priority Data

Mar. 27, 1974 Germany ..... 2414884

[52] U.S. Cl. ..... 337/345; 337/89; 337/343

[51] Int. Cl.[2] ..... H01H 37/54; H01H 37/60

[58] Field of Search ..... 337/89, 343, 53, 365, 337/345, 54, 59; 200/67 R, 67 A

[56] References Cited

UNITED STATES PATENTS

| | | | |
|---|---|---|---|
| 2,769,890 | 11/1956 | Hallerberg et al. | 337/89 |
| 2,840,667 | 6/1958 | Atchison et al. | 337/89 |
| 3,233,056 | 2/1966 | Beck et al. | 200/67 A |
| 3,400,234 | 9/1968 | Long | 200/67 |

*Primary Examiner*—Harold Broome

*Attorney, Agent, or Firm*—Robert E. Burns; Emmanuel J. Lobato; Bruce L. Adams

[57] ABSTRACT

A thermal change-over switch has a switch arm movable between first and second contact positions with an intervening dead center position, a temperature responsive bimetal element is connected to the switch arm through a prestressed resilient element so as to effect quick switch-over of the arm from either position to the other while maintaining contact pressure up to the time of switch-over.

26 Claims, 6 Drawing Figures

THERMAL CHANGE-OVER SWITCH

The invention relates to a thermal change-over switch with a bimetal switch element which is reversibly deformable by the action of heat.

It is known to initiate switching operations by means of bimetal switches, for example where excess currents or short-circuits are likely to occur in networks which have to be protected. The bimetal element through which current flows but which is also capable of responding merely to a change of ambient temperature, for example such as would result from a separate additional heat source, performs a switching motion as the result of heating or cooling so that it is possible to isolate groups of loads from systems which supply current.

It is known to construct bimetal elements so as to obtain a snap action i.e., so-called bimetal diaphragm springs which are maintained in a first position by being specially shaped and are able to change into the other position only after a specific stress point in the bimetal element has been exceeded by heating (or cooling). The change-over motion takes places suddenly and is utilized for opening contacts of switches. Although bimetal diaphragm springs of the kind described above achieve a rapid change-over motion, it is disadvantage that the contact pressure may decrease before the actual snap action. As a result it is possible for opening arcs to form and these could result in contact damage is frequent switching operations are carried out. Moreover, re-closing may give rise to contact chatter which is also difficult to control and may lead to radio interference.

The prior art also discloses mechanically biased microswitches in which the actual contact motion is produced by a resilient intermediate element which produces the snap action. Such microswitches can constitute change-over switches; however, synchronized change-over operation of such switches is not possible in multi-pole embodiments.

According to the invention, we provide a change-over switch having a switch arm movable transversely between first and second limit positions, a respective fixed contact for engagement by the arm in each said position, a thermally deformable bimetal actuating element coupled to the switch arm for moving the latter to one or the other limit position in response to changes in temperature, and a prestressed resilient element acting on the arm which element has two stable positions, corresponding respectively to the said limit positions, and an intervening dead center position, and is arranged to be moved between the said stable positions by deformation of the bimetal element, whereby on such deformation the switch arm will be moved from one limit position to the other with a snap-action.

The present change-over switch is free of the above-mentioned disadvantages of known switches. It operates with a high change-over speed and a contact force which remains sufficiently high prior to the change-over operation. When the bimetal element changes over, the spring force resiliently stored therein and produced by the prevailing change of temperature shall have become so large that long before the two force lines of the contact element system coincide, i.e., the connecting lines of their coupling points, the commencing acceleration will impart to the contact element system a change-over speed which is so high that rupturing arcs either do not occur at all or are immediately extinguished. Any increase of contact resistance which would otherwise occur prior to separation of the contacts is avoided. Unavoidable differences in the snap characteristics of known bimetal switch elements in both switching directions and differences in the snap characteristics between a plurality of such bimetal switch elements can be compensated without significantly impairing the contact force. The thermal and arc-erosive stress applied to the contacts of change-over switches according to the invention is so low that they are able to switch far higher voltages and currents than those which can be switched with know change-over switches and furthermore a substantially longer service life can be achieved for the contact members and therefore for the entire change-over switch.

It would of course be possible to dimension a bimetal diaphragm spring in such a way as to achieve a rapid contact detachment on one side without having to tolerate excessive changes of contact pressure. However, it is not possible to obtain change-over switching in this way because it is obvious that such dimensioning will unavoidably by asymmetrical. The invention however makes it possible to obtain change-over in both switching positions in the form of a sudden rapid switching motion without chatter and with the preceding contact pressure remaining constant. The resilient element ensures that constant contact pressure is maintained together with chatter-free switching on or switching over because this element thrusts the switch arm under constant pressure onto the mating fixed contacts until the over center position is attained. The resilient element compensates for changes of stress and position in the bimetal element and maintains the required contact pressure up to the time at which the dead center state is exceeded, when the spring force stored in the resilient element is used to effect sudden change-over switching.

It is possible for two or more parallel switch arms to be provided which can be non-torsionally connected to a transverse element on which the resilient element acts. In this way it is possible to provide a multi-pole change-over switch with synchronous change-over switching of the parallel switch branches.

The construction and method of operation of exemplary embodiments of the invention are described hereinbelow with reference to the accompanying drawings, in which:

FIG. 1*a* shows a first embodiment of a thermal microswitch, in side view;

FIG. 1*b* is a plan view of the embodiment of FIG. 1;

Figure 4A:
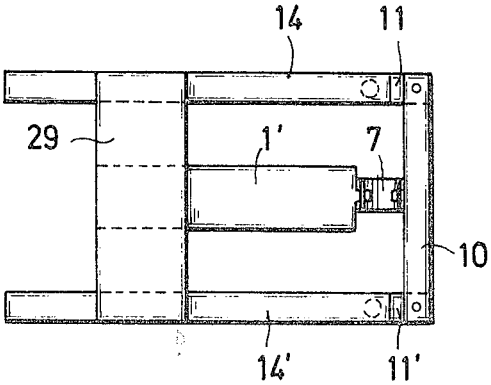

FIG. 4*a* is a plan view of a third embodiment of a change-over switch, and

Figure 4B:
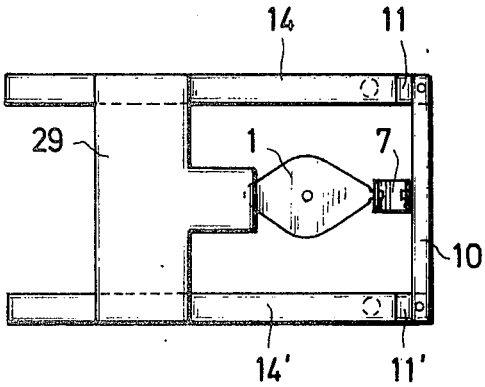

FIG. 4*b* is a plan view of a fourth embodiment of a change-over switch.

Figure 1A:
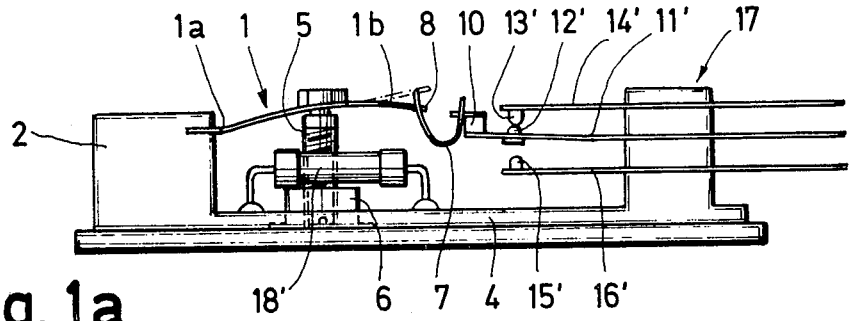
Figure 1B:
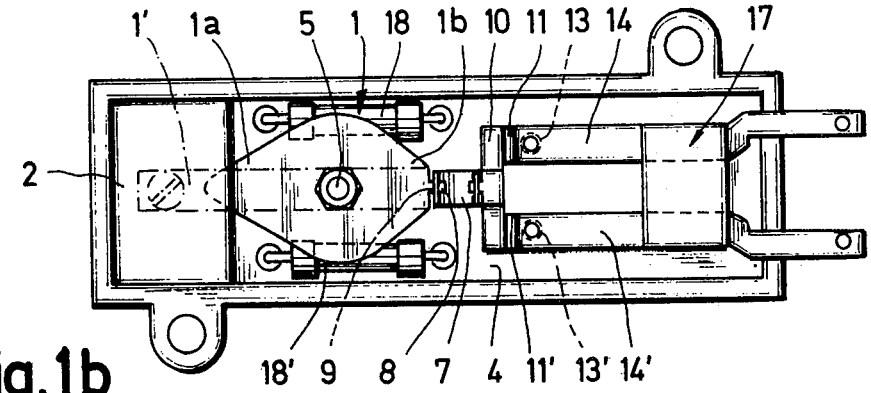

FIGS. 1*a* and 1*b* show a thermal microswitch including a bimetallic switch element constructed either as a bimetallic snap-action resilient diaphragm 1 or as an elongated bimetal strip 1' as indicated in broken lines in FIG. 1*b*.

In the case of the simple elongate bimetal strip 1', the latter is mounted at one end on a holder 2 of the base part 4 of the microswitch and the unclamped end of the bimetal strip 1′ alters its position gradually in response to temperature rise.

In the case of the bimetal snap-action diaphragm 1, the latter is intrinsically prestressed and by virtue of its shape is able to assume two defined stable positions, one stable position being shown in solid lines in FIG. 1*a*, the other stable position being shown in dash-dot lines. The diaphragm 1 remains in a given position for a period of time when subjected to a change of temperature, but the internal stresses change with temperature so that a sudden and instant snap-over into the other position takes place when a specific temperature is exceeded.

The simple bimetal strip 1′ is preferred for switching small load currents, while the bimetal snap-action diaphragm 1 can also be used for the reliable change-over switching of very large load currents.

The embodiment using the bimetal diaphragm 1 will now be described in greater detail. As may be seen by reference to FIG. 1*b*, the bimetal diaphragm 1 is an approximately oval disc and has longitudinal extensions 1*a* and 1*b*, the end 1*a* being firmly clamped in the holder 2. The holder can be mounted in any desired suitable manner on the base part 4.

The middle of the diaphragm is vertically located by a screw 5 mounted in a threaded sleeve 6 on the base part 4 so as to be vertically adjustable for setting the correct switching instant.

A resilient intermediate member 7 is pivoted on the other end 1*b* of the diaphragm 1, a tongue 8 on the end of the diaphragm engaging with a small clearance in an elongated opening 9 of the intermediate element 7 to support the latter while allowing pivoting. In the embodiment of FIGS. 1*a* and 1*b* the intermediate element 7 is a U-shaped leaf spring, the other end of which is pivoted similarly by means of an opening engaging a tongue on a transverse bar 10 the ends of which are connected to parallel switch arms 11 and 11′ carrying contacts 12, 12′.

The transverse bar 10 is insulated from the switch arms 11, 11′, the fixed contact support arms 14, 14′, 16, 16′, and the contacts 12, 12′, 13, 13′, 15, 15′ and advantageously is itself constructed of insulated material. As may be seen, the leaf spring 7 is prestressed by being compressed between the bimetal diaphragm 1 (or the bimetal spring 1′) and the transverse bar 10 so that a substantial thrust is applied to the bar 10 with a transverse component directed upwards or downwards according to the position of the diaphragm. In this way the contacts 12 and 12′ are pressed against the corresponding mating contacts 13 and 13′ or 15 and 15′. The arms 14, 14′, 16, 16′ are non-resilient and are fixedly clamped on the base part 4 in a further holder 17 in the form of an insulating block.

When the diaphragm 1 is in its lower position, the stress in the spring 7 forces the contacts 12, 12′ against the upper fixed contacts 13, 13′. When the diaphragm snaps to its upper position it moves past a dead center position for the spring and hence the direction of the transverse component of the stress in the latter is reversed, and the contacts 12, 12′ are held firmly against the lower contacts 15, 15′.

Changes in the stress in the diaphragm 1 due to temperature changes, and even minor changes in the vertical position of the end 1*b* of the bimetal diaphragm, do not materially alter the contact pressure between the contacts because the contact pressure is applied substantially entirely by the spring force of the leaf spring 7. It is only when the end 1*b* of the bimetal diaphragm suddenly changes position that synchronous and instantaneous change-over switching takes place with a snap-action so that the contacts 12, 12′ are switched to bear, with the same contact pressure and substantially without any chattering, on the other fixed contacts. In this way instantaneous change-over switching is achieved, a feature which was hitherto regarded as unattainable because it was not possible to ensure the necessary contact pressure for each moment of time prior to the actual switching operation. The spring force of the leaf spring 7 which acts in the middle of the transverse bar 10 results in completely synchronous switching operation of the two switching arms 11 and 11′ or multi-pole change-over switching. These two arms are resiliently clamped in the holder 17 and their free ends are non-torsionally coupled to each other by means of the transverse bar 10. Twisting of the switch arms 11 and 11′ is prevented by the transverse bar acting uniformly on the switch arms, which ensures synchronous switching.

The contact arms 14, 14′, 16, 16′ are also supported in the holder 17, and are insulated from and clamped with respect to each other and the switch arms 11, 11′. As already mentioned, the transverse bar 10 is preferably constructed of insulating material, but the connection between the transverse bar 10 and the leaf spring 7 is metallic.

If the bimetal element is the simple elongate bimetal strip 1′ illustrated in FIG. 1*b*, the operation of the switch is substantially as already described except that in this case the free end of the strip 1′ moves progressively in response to a change in temperature. As already mentioned in relation to the bimetal diaphragm 1, such movement has little effect on the contact pressure, which is provided by the spring 7. The latter is also responsible for the snap-action change-over of the contacts when the end of the bimetal strip 1′ passes a dead center position for the spring the transverse component of the stress in the latter will reverse abruptly as already mentioned, thereby causing the arms 11, 11′ to move up or down.

The bimetal switching element 1 or 1′, can be heated by means of heating resistors 18 and 18′ which are disposed above or in the region of the bimetal element. Heating may however also be obtained from an external heat source.

Figure 2:
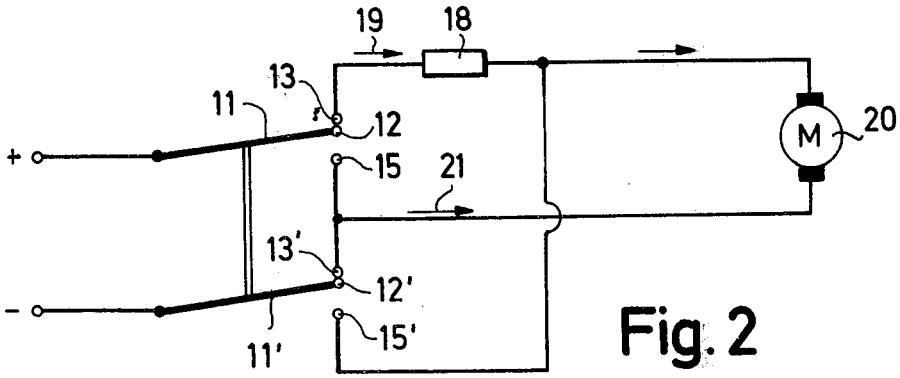
FIG. 2 is a circuit diagram of a circuit containing a change-over switch according to the invention.

FIG. 2 shows the electric circuit which is obtained if the microswitch according to FIG. 1*a* and 1*b* is used in conjunction with a load 20 e.g. a motor. In one switch position current flows from the positive terminal in the direction of the arrow 19 through the resistor 18 and through the load 20 and returns to the negative terminal. In the other switch position current flows in the direction of the arrow 21 i.e., the load current is reversed, and the current bypasses the resistor 18. As may be seen, such a circuit has oscillating characteristics and provides periodic return into initial position. Such oscillating characteristics can be utilized in suitable manner.

Figure 3:
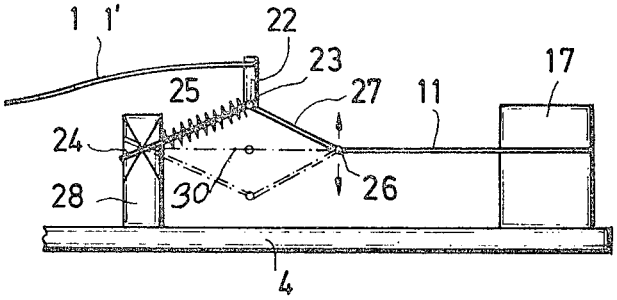
FIG. 3 shows a sectional form a further embodiment of a change-over.

FIG. 3 shows a further exemplified embodiment of a thermal microswitch, only those parts which are essential for understanding being shown. The bimetal element 1 or 1′ acts via a smaller intermediate part 22 on a pivoting point 23 on which act a helical compression spring 25, which is guided by a guide pin 24 and surrounds the latter, and the resilient switch arm 11 or a pivoted end part 27 thereof. The switch arm is supported in the holder 17 and is pivoted at 26 to the switch arm part 27 which acts on the pivoting point 23. The guide pin 24 can slide in a guide block 28 against which the spring 25 bears.

In the position of the spring 25 and the pivot point 23 as shown in solid lines in FIG. 3, a downward force acts on the joint 26, thus achieving downward deflection of the resilient switch arm 11. If the bimetal element 1 or 1' moves the pivot 23 down past the dead center position shown by broken line 30, the transverse component of the pressure exerted by the prestressed spring 25 on the pivot point is abruptly reversed and the pivot point and components 24, 27 snap into a lower position shown in broken lines, whereby an upward force is exerted on the joint 26, causing the arm 11 to snap into its upper position. It will be seen that the left hand end of the spring is supported in the median or dead center plane, which is perpendicular to a line joining the upper and lower fixed contacts (not shown). Instead of the bimetal strip 1', a bimetallic snap-action resilient diaphragm can be used as in the thermal switch illustrated in FIGS. 1*a* and 1*b*.

FIGS. 4*a* and 4*b* show further embodiments whose mode of operation is substantially identical to that of FIGS. 1*a* and 1*b* but the switch arms 11, 11' and the contact arms 14, 14', 16, 16' are disposed on the same side of the bar 10 as the bimetal element 1 or 1', alongside the latter, so that the microswitch is somewhat broader but substantially shorter than that of FIGS. 1*a* and 1*b*, for special applications. In FIGS. 4*a* and 4*b* parts which are identical to those of FIGS. 1*a* and 1*b* have the same reference numerals, the components being clamped in a common holder 29 which is constructed as an insulating block.

What we claim and desire to secure by letters patent is:

1. A change-over switch comprising a plurality of switch arms disposed parallel to each other and movable between first and second limit positions, a transverse member non-torsionally interconnecting said switch arms, a plurality of fixed contacts for engagement respectively by said switch arms in each said position, a thermally deformable bimetal actuating element for moving said switch arms to one or the other limit position in response to changes in temperature, and a prestressed resilient element coupling said bimetal element with said transverse member, said resilient element having two stable positions corresponding respectively to the said limit positions and an intervening dead center position, and is arranged to be moved between the said stable positions by deformation of the bimetal element, whereby on such deformation the switch arms will be moved from one limit position to the other with a snap-action.

2. A switch as claimed in claim 1 in which the resilient element is a U-shaped leaf spring pivoted at respective ends to and compressed between the bimetal element and the transverse member.

3. A switch as claimed in claim 2 in which the ends of the spring have openings engaging tongues provided on the bimetal element and the transverse member respectively.

4. A switch as claimed in claim 1 in which the bimetal element is articulated to the transverse member, and the resilient elements bears at one end on a fixed abutment and at the other end on the transverse member and the bimetal element.

5. A switch as claimed in claim 4 in which the resilient element is a helical compression spring.

6. A switch as claimed in claim 5 in which the spring encloses a guide pin.

7. A switch as claimed in claim 1 in which the bimetal element is a bimetal strip.

8. A switch as claimed in claim 1 in which the bimetal element is a snap-action resilient bimetal diaphragm.

9. A switch as claimed in claim 8 in which the diaphragm is an oval disc.

10. A switch as claimed in claim 8 in which the diaphragm is fixed in one edge region thereof and movable at an opposite edge region, and an intermediate region is located against movement transverse to the general plane of the diaphragm.

11. A switch as claimed in claim 10 including adjustable locating means locating the said intermediate region.

12. A switch as claimed in claim 1 in which each fixed contact is carried by a respective support arm.

13. A switch as claimed in claim 1 in combination with an electrical heat source arranged to heat the bimetal element and connected to be energized in one switch position and deenergized in the other switch position.

14. A change-over switch comprising a switch arm movable between first and second limit positions, a respective fixed contact for engagement by the switch arm in each said position, a thermally deformable bimetal actuating element comprising a snap-action resilient bimetal diaphragm having a portion movable by snap action between first and second limit positions, and means coupling said movable portion of said bimetal diaphragm with said switch arm, said coupling means comprising a prestressed resilient element acting between said movable portion of the bimetallic diaphragm and the switch arm, said resilient element having two stable positions corresponding respectively to the said limit positions, and an intervening dead center position, and is arranged to be moved between the said stable positions by the snap action of the bimetal diaphragm from one stable position to the other, whereby on such snap action of the bimetal diaphragm the switch arm will be moved from one limit position to the other with a snap-action, the contact pressure of said switch arm on the respective fixed contact remaining essentially constant until said snap-action movement of the switch arm.

15. A switch as claimed in claim 14 in which the resilient element is a U-shaped leaf spring pivoted at respective ends to and compressed between the movable portion of the bimetal diaphragm and the switch arm.

16. A switch as claimed in claim 15 in which the ends of the U-shaped leaf spring have openings engaging tongues provided on the movable portion of the bimetal diaphragm and the switch arm respectively.

17. A switch as claimed in claim 14 in which the bimetal diaphragm is articulated to the switch arm, and the resilient element bears at one end on a fixed abutment and at the other end on the switch arm and the movable portion of the bimetal diaphragm.

18. A switch as claimed in claim 17 in which the resilient element is a helical compression spring.

19. A switch as claimed in claim 18 in which the spring encloses a guide pin.

20. A switch as claimed in claim 14 in which the bimetal diaphragm is an oval disc, said movable portion being an end portion of said disc.

21. A switch as claimed in claim 14 in which the bimetal diaphragm is fixed in one edge region thereof and movable at an opposite edge region, and an intermediate region is located against movement transverse to the general plane of the diaphragm.

22. A switch as claimed in claim 21 including adjustable locating means locating the said intermediate region.

23. A switch as claimed in claim 14 in which each fixed contact is carried by a respective support arm.

24. A switch as claimed in claim 14 in combination with an electrical heat source arranged to heat the bimetal diaphragm and connected to be energized in one switch position and deenergized in the other switch position.

25. A change-over switch comprising a switch arm movable transversely between first and second limit positions, a respective fixed contact for engagement by the arm in each said position, a thermally deformable bimetal actuating element coupled to the switch arm for moving the latter to one or the other limit position in response to changes in temperature, and a prestressed resilient element acting on the arm, said resilient element having two stable positions corresponding respectively to the said limit positions, and an intervening dead center position, and is arranged to be moved between the said stable positions by deformation of the bimetal element, whereby on such deformation the switch arm will be moved from one limit position to the other with a snap-action, said bimetal element being articulated to the switch arm and said resilient element comprises a helical compression spring enclosing a guide pin and bearing at one end on a fixed abutment and at the other end on the articulation between said bimetal element and said switch arm.

26. A switch as claimed in claim 25 in which said bimetal element is a bimetal strip fixed at one end and articulated to said switch arm at the opposite end.

* * * * *